US005659979A

United States Patent [19]

Sileo

[11] Patent Number: 5,659,979

[45] Date of Patent: Aug. 26, 1997

[54] TRANSPARENT FOOTWEAR WITH INTERCHANGEABLE TONGUE AND INSOLE AND KIT THEREFORE

[76] Inventor: Steve Sileo, 61 Redwood Ave., Edison, N.J. 08817

[21] Appl. No.: 323,871

[22] Filed: Oct. 17, 1994

Related U.S. Application Data

[63] Continuation of Ser. No. 117,923, Sep. 7, 1993, abandoned.

[51] Int. Cl.[6] ..... A43B 23/26; A43B 3/24; B65D 69/00

[52] U.S. Cl. ..... 36/54; 206/223; 36/100

[58] Field of Search ..... 36/45, 54, 100, 36/101, 50.1, 112, 25 R, 136; 206/278, 223

[56] References Cited

U.S. PATENT DOCUMENTS

| | | | |
|---|---|---|---|
| 624,587 | 5/1899 | Webber | 36/54 X |
| 923,860 | 6/1909 | Kroell | 36/54 |
| 945,698 | 1/1910 | Conway | 36/3 B |
| 1,172,736 | 2/1916 | Rice . | |
| 1,608,879 | 11/1926 | Hawkins . | |
| 1,729,797 | 10/1929 | O'Gorman | 206/278 |
| 1,777,747 | 10/1930 | DeWitt . | |
| 2,207,699 | 7/1940 | Pliskoff et al. . | |
| 2,239,206 | 3/1941 | Tietig . | |
| 2,381,389 | 8/1945 | Riesing . | |
| 2,425,388 | 8/1947 | Oestricher . | |
| 2,559,014 | 7/1951 | Fortier . | |
| 2,759,284 | 8/1956 | Santisi | 36/136 X |
| 2,887,792 | 5/1959 | Staff | 36/45 |
| 2,889,639 | 6/1959 | Rudine | 36/25 R |
| 2,982,033 | 5/1961 | Bingham, Jr. | 36/55 X |
| 3,596,381 | 8/1971 | Fukuoka | 36/11.5 |
| 3,822,489 | 7/1974 | Johnson | 36/25 R |
| 3,925,915 | 12/1975 | Colli | 36/11.5 |
| 4,347,673 | 9/1982 | Suetlik | 36/32 R |
| 4,348,820 | 9/1982 | D'Alessio | 36/101 |
| 4,370,818 | 2/1983 | Simoglou | 35/100 |
| 4,461,102 | 7/1984 | DeVincentis | 36/101 |
| 4,635,385 | 1/1987 | Ogden | 36/43 |
| 4,651,447 | 3/1987 | Sullivan | 36/50.1 X |
| 4,658,515 | 4/1987 | Oatman | 36/43 X |
| 4,727,661 | 3/1988 | Kuhn | 36/100 |
| 4,766,680 | 8/1988 | Maciel et al. | 36/87 |
| 4,805,321 | 2/1989 | Tonkel | 36/136 X |
| 4,995,173 | 2/1991 | Spier | 36/29 |
| 5,014,041 | 5/1991 | Rosen | 36/112 X |
| 5,065,531 | 11/1991 | Prestridge | 36/100 |
| 5,083,385 | 1/1992 | Halford | 36/101 |
| 5,084,988 | 2/1992 | Berger | 36/112 |
| 5,154,682 | 10/1992 | Kellerman | 36/44 |

FOREIGN PATENT DOCUMENTS

| | | | |
|---|---|---|---|
| 442094 | 2/1936 | United Kingdom | 36/54 |

*Primary Examiner*—B. Dayoan
*Attorney, Agent, or Firm*—Lerner, David, Littenberg, Krumholz & Mentlik

[57] ABSTRACT

In a pair of laced footwear, each item of footwear includes a sole and an upper which are formed from a transparent material. The footwear includes a tongue and insole which are removably assembled to the footwear and which are provided with non-transparent indicia consisting of a solid color or a suitable design or pattern which will be clearly visible through the footwear when the insole and tongue are assembled thereto. The indicia on opposite surfaces of the tongue may be different from each other, yet may be the same as the indicia on opposite surfaces of the insole. A shoelace for tightening the footwear around the foot of a wearer includes indicia which may or may not be the same as the indicia on at least one of the surfaces of the tongue or insole. Convenient packages consisting of two tongues, two insoles and two shoelaces having coordinating indicia may be made available for changing the appearance of the footwear to achieve a desired look.

10 Claims, 5 Drawing Sheets

TRANSPARENT FOOTWEAR WITH INTERCHANGEABLE TONGUE AND INSOLE AND KIT THEREFORE

This is a continuation, of application Ser. No. 08/117,923 filed Sep. 7, 1993, abandoned.

FIELD OF THE INVENTION

The present invention relates generally to footwear, and more particularly to transparent footwear, the appearance of which can be altered to achieve different aesthetic affects. Still more particularly, the present invention relates to transparent footwear having a tongue and insole which include non-transparent indicia and which can be removed and either reversed or replaced with a different tongue and insole to change the overall aesthetic appearance of the footwear.

BACKGROUND OF THE INVENTION

In recent years, footwear has received greater attention as an increasingly important fashion accessory. Nowhere is this more apparent than in the sneaker industry which has rapidly evolved from the traditional white or black canvas high top or low cut sneaker to now include a staggering array of styles, designs, colors and materials. The widespread availability of different styles, designs and colors now enables people, particularly children, teenagers and young adults, to make a fashion statement by coordinating their sneakers with the rest of their clothing. Because of this, it is not uncommon for one person to own several different pairs of sneakers to be worn on different occasions and with different outfits.

One drawback to this desire to own many different pairs of sneakers is cost. In this regard, the availability of sneakers in a wide range of styles, designs and colors and their increased popularity have driven up the price of sneakers substantially. This, in combination with the desire to have several pairs of sneakers, has placed a significant financial burden on purchasers.

A similar situation exists in the context of women's shoes, where women find it important to have a pair of shoes to match each of their outfits. Attempts have been made in the past to diminish the cost impact of this need by providing transparent footwear having inserts which can be changed to match the particular outfit being worn.

One such effort is documented in U.S. Pat. No. 2,887,792 to Staff. This patent is directed to a pair of transparent plastic women's pumps having a removable insert which is colored or textured to match the ensemble being worn. The insert is positioned behind a transparent vamp so that its color or design is clearly visible. In addition to the vamp, the heel of the shoe is also formed from a transparent material, although the outer sole and inner sole are not.

In Riesing, U.S. Pat. No. 2,381,389, a shoe is formed with a transparent or translucent bottom to which is attached colored straps or ribbons for holding the shoe to the wearer's foot. The patentee states that the straps or ribbons may be changed to those of a different color in order to match the clothes of the wearer.

Although the foregoing references describe efforts to change the appearance of a pair of footwear, the footwear industry generally has failed to suggest a way of quickly and inexpensively changing the overall appearance of sneakers and other laced shoes. More particularly, there has been a failure in the footwear industry to suggest the desirability of providing transparent laced footwear, and specifically transparent sneakers, the overall appearance of which can be easily changed to reflect the whim and desire of the wearer. There therefore exists a need for laced footwear, and particularly transparent sneakers, which can be modified with little effort to create an entirely different overall aesthetic appearance.

SUMMARY OF THE INVENTION

The present invention addresses this need by providing an article of footwear including a transparent upper and a sole connected to the upper. Preferably, the sole is also formed from a transparent material. The article of footwear further includes a tongue having opposed front and back surfaces removably mounted to the upper in a first position with the front surface facing away from the sole and the back surface facing toward the sole. Non-transparent indicia are formed on at least one of the front and back surfaces of the tongue.

In a preferred embodiment, the article of footwear further includes mounting means for removably mounting the tongue to the upper in the first position and for removably mounting the tongue to the upper in a second position in which the front surface faces toward the sole and the back surface faces away from the sole. In this preferred embodiment, a first non-transparent indicia may be formed on the front surface of the tongue and a second non-transparent indicia may be formed on the back surface of the tongue. The non-transparent indicia formed on the front surface of the tongue may be different from the non-transparent indicia formed on the back surface of the tongue. Preferably, these non-transparent indicia include different colors and/or different patterns.

In one variant, the mounting means may include a hook member connected to an attachment end of the tongue and a receiving aperture formed in the upper, the receiving aperture being sized and shaped for removably receiving the hook member in assembled position.

In another variant, the article of footwear includes a plurality of opposed lacing eyelets formed on the upper and a lace threadedly engaged therethrough, and the mounting means may include a first pair of spaced apertures formed in an attachment end of the tongue and a second pair of spaced apertures formed in the upper. In this variant, threading the lace through the first and second pairs of spaced apertures removably mounts the tongue to the upper.

In yet another variant, the article of footwear includes a plurality of opposed lacing eyelets formed on the upper, a receiving cavity formed in the upper at one end of the plurality of opposed lacing eyelets and a lace threadedly engaged through the plurality of opposed lacing eyelets. In accordance with this variant, the mounting means may include a mounting member fixedly connected to an attachment end of the tongue and receivable within the receiving cavity in assembled position, the mounting member including a pair of opposed extensions projecting outwardly from the receiving cavity in the assembled position of the mounting member.

In a more preferred embodiment, the article of footwear further includes an insole removably arranged within the upper, the insole having a top surface facing away from the sole and a bottom surface facing toward the sole. Non-transparent indicia may be formed on at least one of the top and bottom surfaces of the insole. In this embodiment, the top surface of the insole may include third non-transparent indicia and the bottom surface of the insole may include fourth non-transparent indicia which may be different from the third non-transparent indicia. In a particularly preferred embodiment, the first indicia on the tongue is the same as the fourth indicia on the insole and the second indicia on the tongue is the same as the third indicia on the insole.

In still another embodiment, a lace having fifth indicia may be threadedly engaged through a plurality of opposed lacing eyelets in the upper. The fifth indicia preferably will be selected from the group consisting of the first and second indicia.

Another aspect of the present invention provides a kit for decorating an item of footwear having an upper and a sole connected to the upper. In accordance with this aspect of the present invention, the kit may include a tongue having first indicia formed on a front surface and second indicia formed on a back surface, and an insole having third indicia formed on a top surface and fourth indicia formed on a bottom surface. Preferably, the first indicia will be the same as the fourth indicia and the second indicia will be the same as the third indicia. Still more preferably, the kit may further include a lace having fifth indicia selected from the group consisting of the first and second indicia.

BRIEF DESCRIPTION OF THE DRAWINGS

A more complete appreciation of the subject matter of the present invention and the various advantages thereof can be realized by reference to the following detailed description, in which reference is made to the accompanying drawings in which.

DETAILED DESCRIPTION OF THE PREFERRED EMBODIMENTS

In the detailed description which follows, the features of the present invention will be described as applied to a pair of athletic shoes or sneakers. However, it will be appreciated that the various features of the present invention may be readily incorporated in other forms of footwear having tongues, including casual shoes, dress shoes, oxfords and the like.

Figure 1:
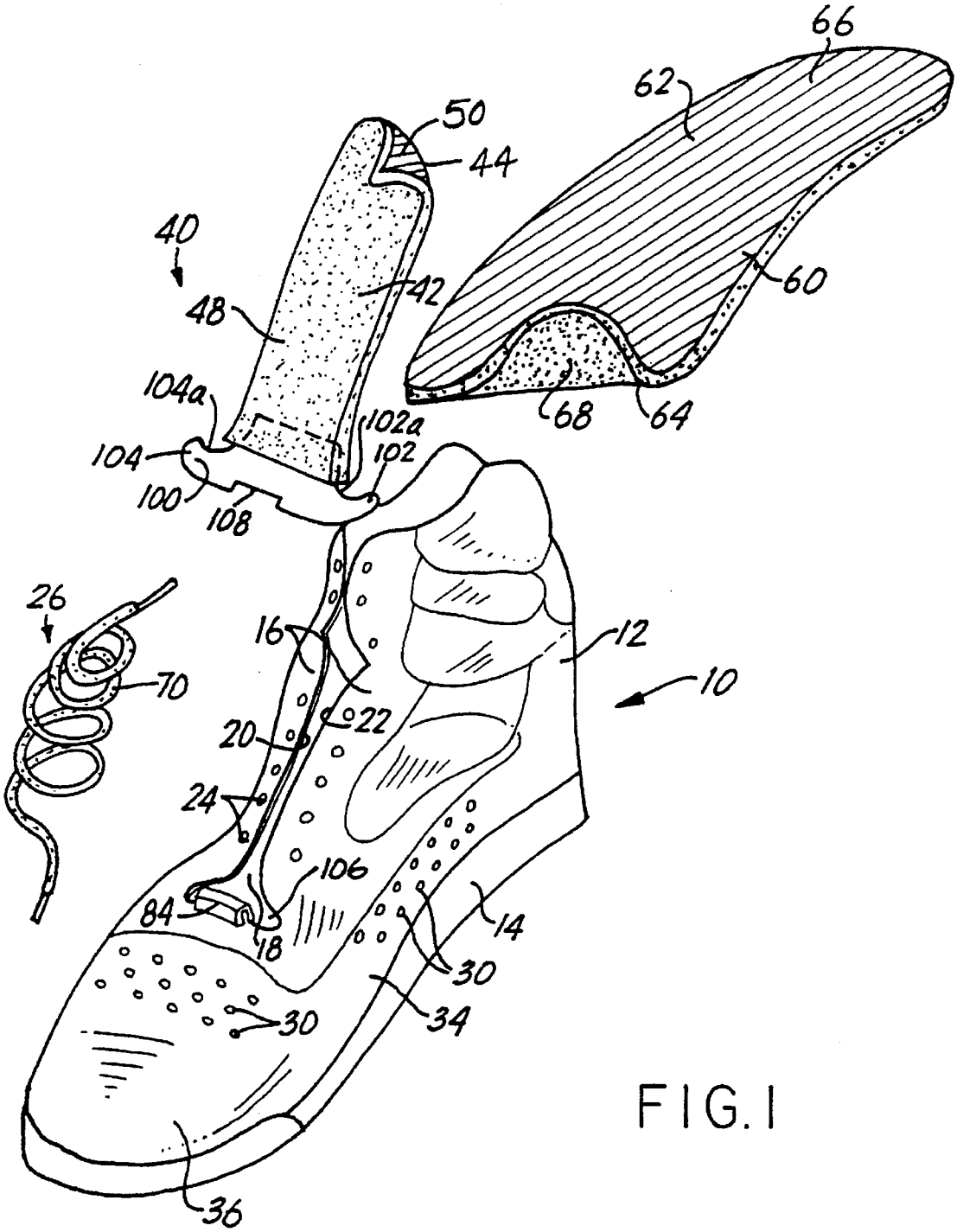
FIG. 1 is a perspective view showing the components of a single item of footwear in accordance with the present invention in an unassembled condition.
Figure 2:
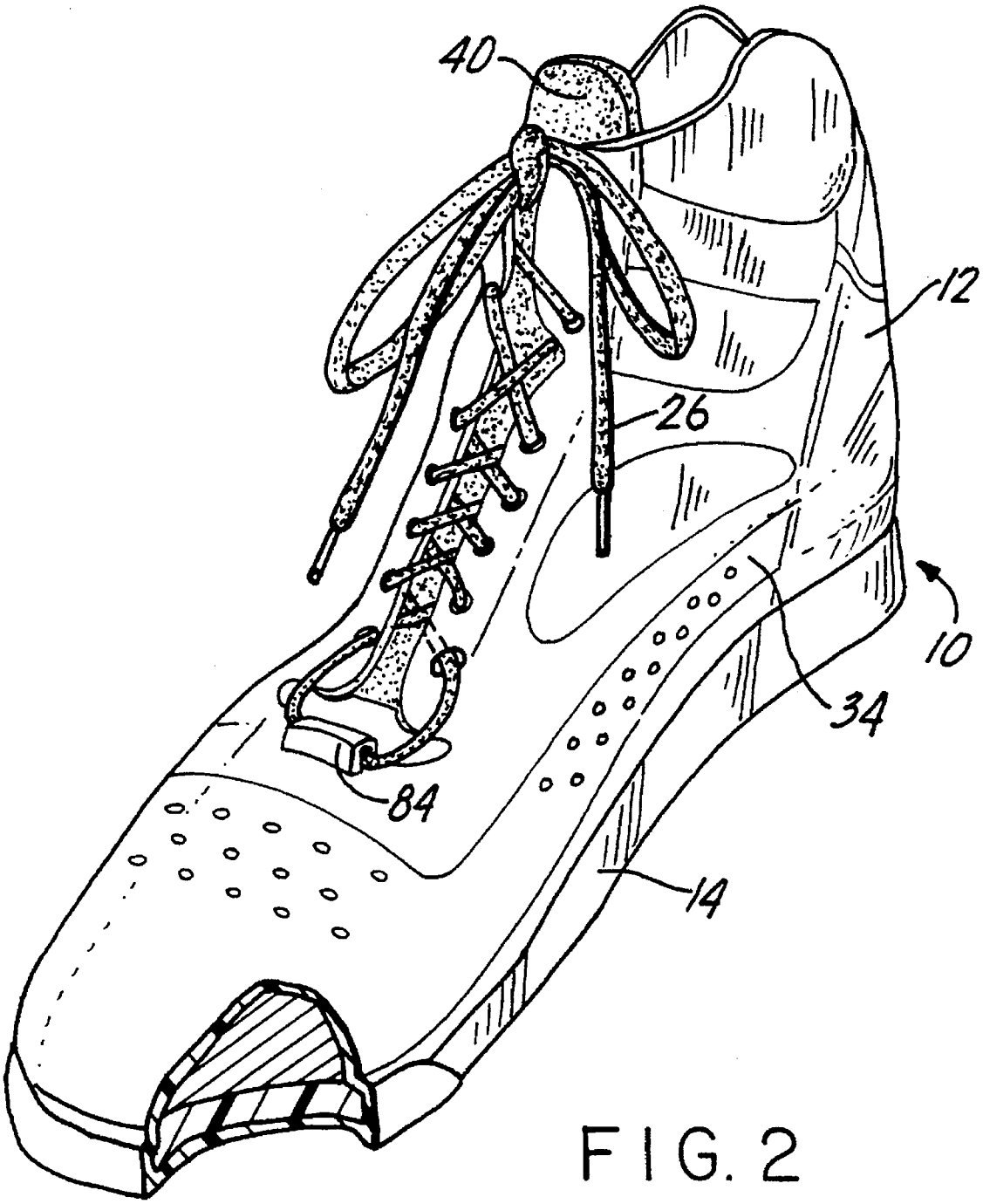
FIG. 2 is a perspective view of the item of footwear shown in FIG. 1 in the assembled condition, partially broken away to show the interior thereof.
Figure 3:
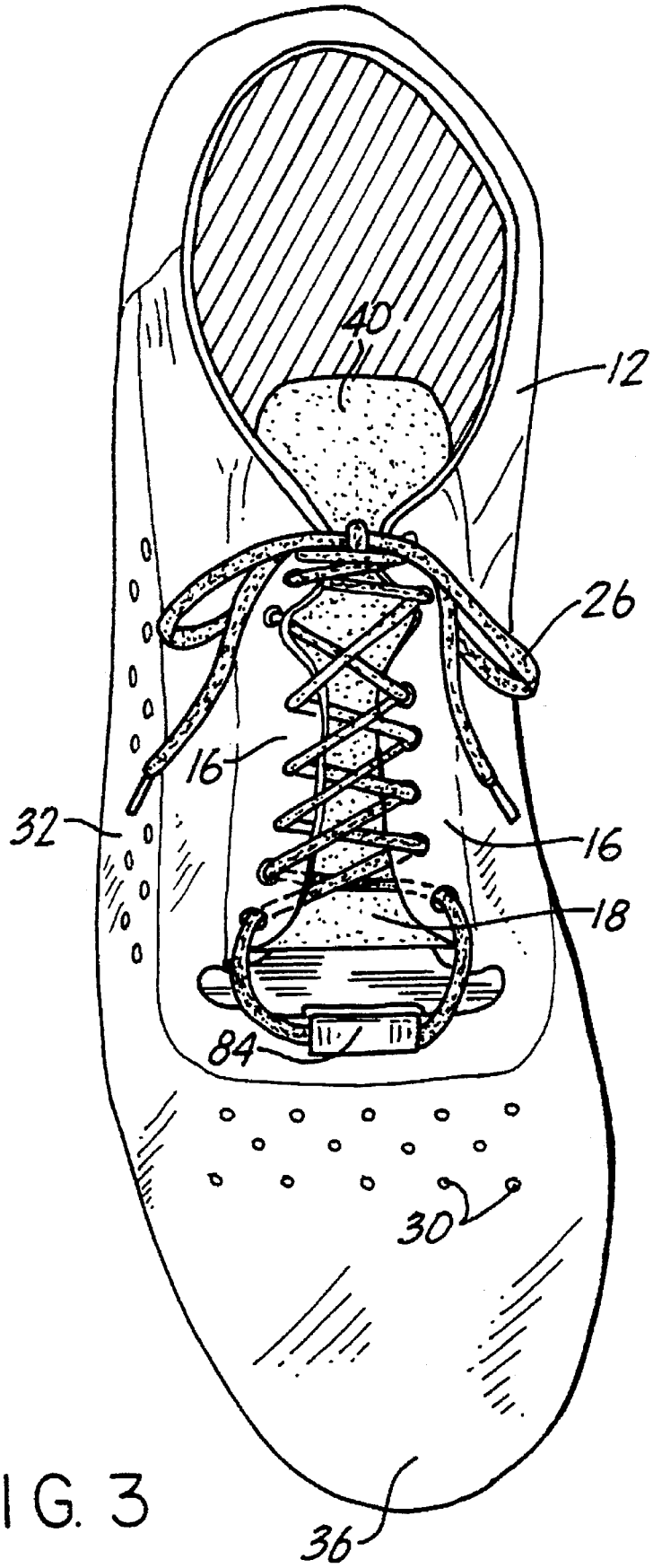
FIG. 3 is a plan view of the item of footwear shown in FIG. 2.

Referring to FIGS. 1–3, there is illustrated a preferred embodiment of an item of footwear in the form of a sneaker, generally designated as 10, in accordance with the present invention. The sneaker 10 as illustrated is shaped to fit the right foot of the wearer and is typically paired with another sneaker (not shown) which is in all respects identical to, but a mirror image of sneaker 10, and shaped to fit the left foot of the wearer. For purposes of the present description, the construction of only right sneaker 10 will be discussed in full detail below, each of the features described in connection with right sneaker 10 also being found on the left sneaker.

Sneaker 10 includes an upper portion 12 and a sole 14 which have a generally conventional construction, but which are both formed from a flexible transparent material, such as polyvinyl chloride. Desirably, upper portion 12 and sole 14 will be formed from a colorless transparent material, although transparent materials which are tinted with a color may also be used. In a preferred arrangement, upper 12 and sole 14 may be integrally formed as a single unit in an injection molding process. Although sneaker 10 is depicted in the figures as having a high-top style upper 12, it is contemplated that sneaker 10 alternatively may be provided with an upper 12 having a low-cut style.

The upper 12 includes a pair of opposed flaps 16 defining a throat or opening 18 between the opposed edges 20 and 22 thereof. A multiplicity of pairs of opposed lacing eyelets 24 are spaced uniformly along the opposed edges 20 and 22 of the flaps 16 adjacent the throat 18. In normal use, a shoelace 26 is threaded through the lacing eyelets 24 and enables the opposed edges 20 and 22 of the flaps 16 to be drawn together over the foot of the wearer. In an alternate and less preferred arrangement, straps including conventional hook and loop fasteners may be used rather than laces to hold sneaker 10 in a closed condition about the wearer's foot. Sneaker 10 optionally may be provided with a plurality of apertures 30 on the side portions 32 and 34 and/or on the toe portion 36 to permit air to circulate into and out from the interior of the sneaker.

A tongue 40 is removably connected at one end to upper 12 of sneaker 10 so that, in the assembled position, tongue 40 lies beneath flaps 16 and within opening 18. Tongue 40 preferably has a laminar construction consisting of a top layer 42 and a bottom layer 44, with a layer of cushioning material (not shown) interposed therebetween so that the tongue 40 will feel comfortable against the wearer's foot. With tongue 40 assembled to upper 12, top layer 42 will face away from sole 14 and bottom layer 44 will face toward sole 14. Layers 42 and 44 are provided with non-transparent indicia 48 and 50, respectively, which will be clearly visible not only through the opening 18 between edges 20 and 22 of flaps 16, but also through the flaps themselves as a result of the transparent material from which they are formed. Indicia 48 and 50 may include, for example, a solid color, any type of pattern such as polka-dots, stripes, checks, or plaid or paisley patterns, or any other suitable design. Preferably, the indicia 48 on top layer 42 is different than the indicia 50 on bottom layer 44 so that, as described further below, the attachment of tongue 40 to sneaker 10 may be reversed so that the indicia on the opposite side of the tongue will be visible.

Sneaker 10 further includes a removable insole 60 which conforms generally to the shape of sole 14 in a typical fashion. Insole 60 may have a conventional construction which preferably includes a resilient material for cushioning the foot of the wearer. A top surface 62 of insole 60 faces away from sole 14 when the insole is assembled in sneaker 10 and a bottom surface 64 of insole 60 faces toward sole 14 when the insole is in the assembled position. The top surface 62 of insole 60 is provided with non-transparent indicia 66 which is clearly visible through transparent upper 12 when sneaker 10 is not being worn. Non-transparent indicia 68 on the bottom surface 64 of insole 60 will be visible through sole 14 when sneaker 10 is lifted from a supporting surface whether or not sneaker 10 is being worn. Indicia 66 and 68 may include a solid color or any suitable pattern or design, and may or may not be the same as indicia 48 and 50 on tongue 40. Preferably, the indicia 66 on the top surface 62 of insole 60 will be different than the indicia 68 on the bottom surface 64 so that, as a result of exchanging the insoles between the sneakers in a pair of sneakers, the indicia on the top and bottom surfaces of the insoles will be reversed. More preferably, the indicia on one surface of insole 60 will be the same as the indicia on one surface of tongue 40, and the indicia on the opposite surface of insole 60 will be the same as the indicia on the other surface of tongue 40. In this regard, a particularly appealing aesthetic effect is achieved when the indicia 48 on the top layer 42 of tongue 40 is the same as or coordinates with the indicia 68 on the bottom surface 64 of insole 60. The indicia 50 on the bottom layer 44 of tongue 40 will then be the same as or coordinate with indicia 66 on the top surface 62 of insole 60. Shoelace 26 also preferably includes non-transparent indicia 70 in the form of a solid color or a suitable pattern or design. Desirably, indicia 70 is the same as or coordinates with at least one of indicia 48, 50, 66 or 68.

Figure 4:
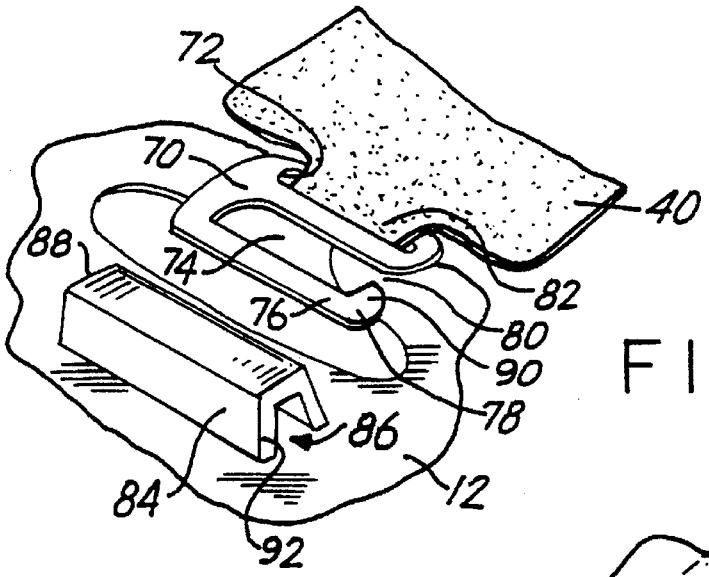
FIG. 4 is an exploded fragmentary view showing the attachment of the tongue to the item of footwear in accordance with one embodiment of the present invention.

One method for removably mounting tongue 40 to upper 12 is illustrated in FIG. 4. In accordance with this method, an attachment end of tongue 40 is provided with a hook connector 70 which includes a first fully enclosed elongated slot 72 and a second slot 74 defined by an arm 76 which is unconnected at a free end 78 to define an opening 80. A loop of fabric 82 threaded through enclosed slot 72 and sewn to the attachment end of tongue 40 secures hook connector 70 to the tongue. Preferably, the fabric loop 82 includes one of the indicia on tongue 40 so as not to detract from the overall appearance of sneaker 10. It is also preferable to form hook connector 70 from a transparent material, such as a rigid transparent polymer which is colorless or which is tinted with the same transparent color as upper 12 so as to be practically invisible when assembled to sneaker 10.

At the lower end of opening 18, an inverted, generally U-shaped member 84 is integrally molded with or otherwise connected to upper 12 to define therethrough an elongated aperture 86. Tongue 40 may be mounted to upper 12 by inserting the free end 78 of arm 76 into aperture 86 from the end 88 of U-shaped member 84. When assembled in this fashion, the indicia 48 on the top layer 42 of tongue 40 will face upwardly and will thus be visible to the observer. An enlarged portion 90 formed on the free end 78 of arm 76 prevents hook connector 70 from working free from aperture 86, although the resilient nature of U-shaped member 84 will enable hook connector 70 to be removed from the aperture upon the application of force. To change the appearance of sneaker 10, tongue 40 can be inverted so that the indicia 50 on the bottom layer 44 of the tongue is visible merely by disengaging hook connector 70 from the aperture 86 in U-shaped member 84, inverting tongue 40 and then re-inserting the free end 78 of arm 76 into aperture 86 from the opposite end 92 of U-shaped member 84.

Figure 5:
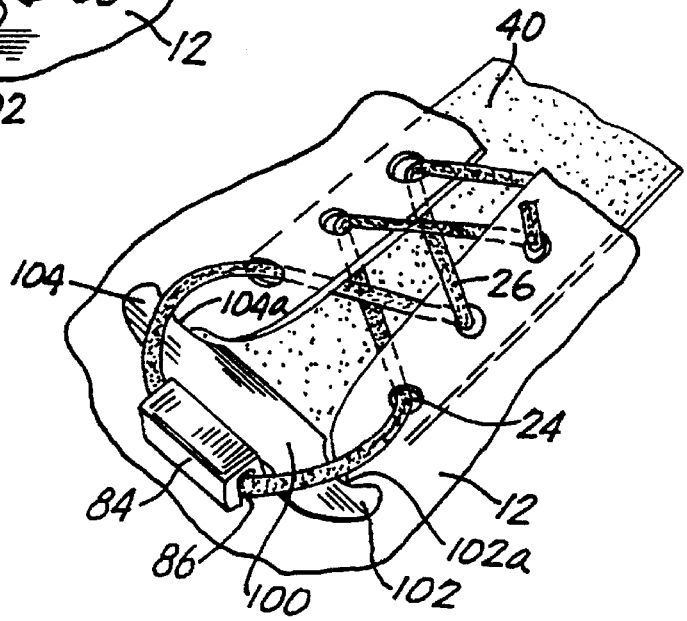
FIG. 5 is an exploded fragmentary view showing the attachment of the tongue to the item of footwear in accordance with another embodiment of the present invention.

An alternate method for mounting tongue 40 to upper 12 so that tongue 40 may be removed and remounted in an inverted position is shown in FIG. 5. In this method, an insert 100 formed from a rigid or semi-rigid material and secured to the attachment end of tongue 40 includes a pair of opposed extensions 102 and 104. With tongue 40 mounted to upper 12, insert 100 resides within an enlarged cutout 106 (FIG. 1) at the lower end of opening 18 with extensions 102 and 104 extending out from cutout 106 and over the top of upper 12 such that edges 102*a* and 104*a* of extensions 102 and 104 engage the lower ends of flaps 16. A notch 108 formed in the edge of insert 100 is sized and shaped to receive U-shaped member 84 and to locate tongue 40 in an appropriate position with respect to the opening 18 in upper 12. The material for forming insert 100 is preferably sufficiently rigid that the extensions 102 and 104 will deform only minimally and inconsequentially as the tongue 40 is pulled away from toe portion 36 for inserting the wearer's foot into sneaker 10. In this regard, insert 100 is preferably formed from a colorless transparent material or a transparent material which is tinted with the same color as upper 12 so as to not affect sneaker 10 aesthetically. Alternatively, insert 100 may be formed from a non-transparent material which is inserted between top layer 42 and bottom layer 44 of tongue 40 or which includes at least one of the indicia on tongue 40 so as to present a uniform, coordinated appearance.

Once tongue 40 has been mounted to upper 12 by the engagement of extensions 102 and 104 with the lower ends of flaps 16, it is held in place with respect thereto by threading shoelace 26 through aperture 86 in U-shaped member 84 and then through lacing eyelets 24 so that a portion of shoelace 26 lies over extensions 102 and 104. As shoelace 26 is tightened to draw the opposed edges 20 and 22 of flaps 16 toward one another, the portion of shoelace 26 overlying extensions 102 and 104 will hold tongue 40 against upper 12 in assembled position. The indicia on the opposite side of tongue 40 can be displayed merely by removing shoelace 26 from lacing eyelets 24, inverting tongue 40 and rethreading shoelace 26 through the lacing eyelets so that a portion of shoelace 26 lies over extensions 102 and 104.

Figure 6:
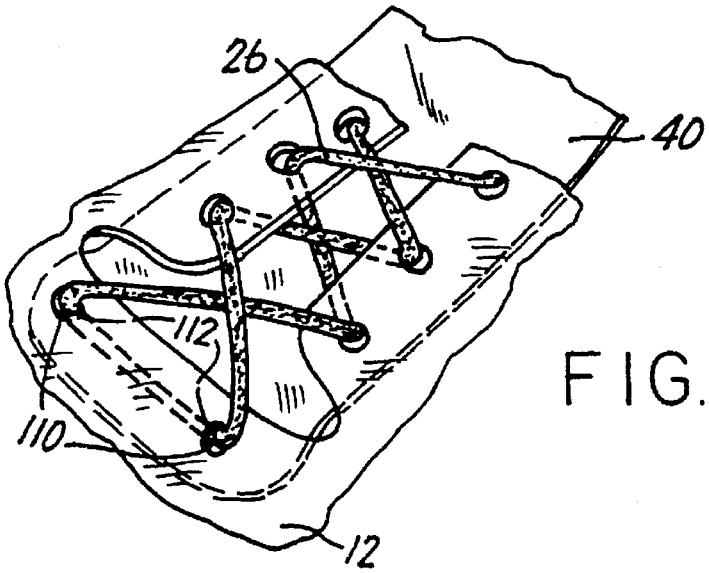
FIG. 6 is an exploded fragmentary view showing the attachment of the tongue to the item of footwear in accordance with yet another embodiment of the present invention.
Figure 7:
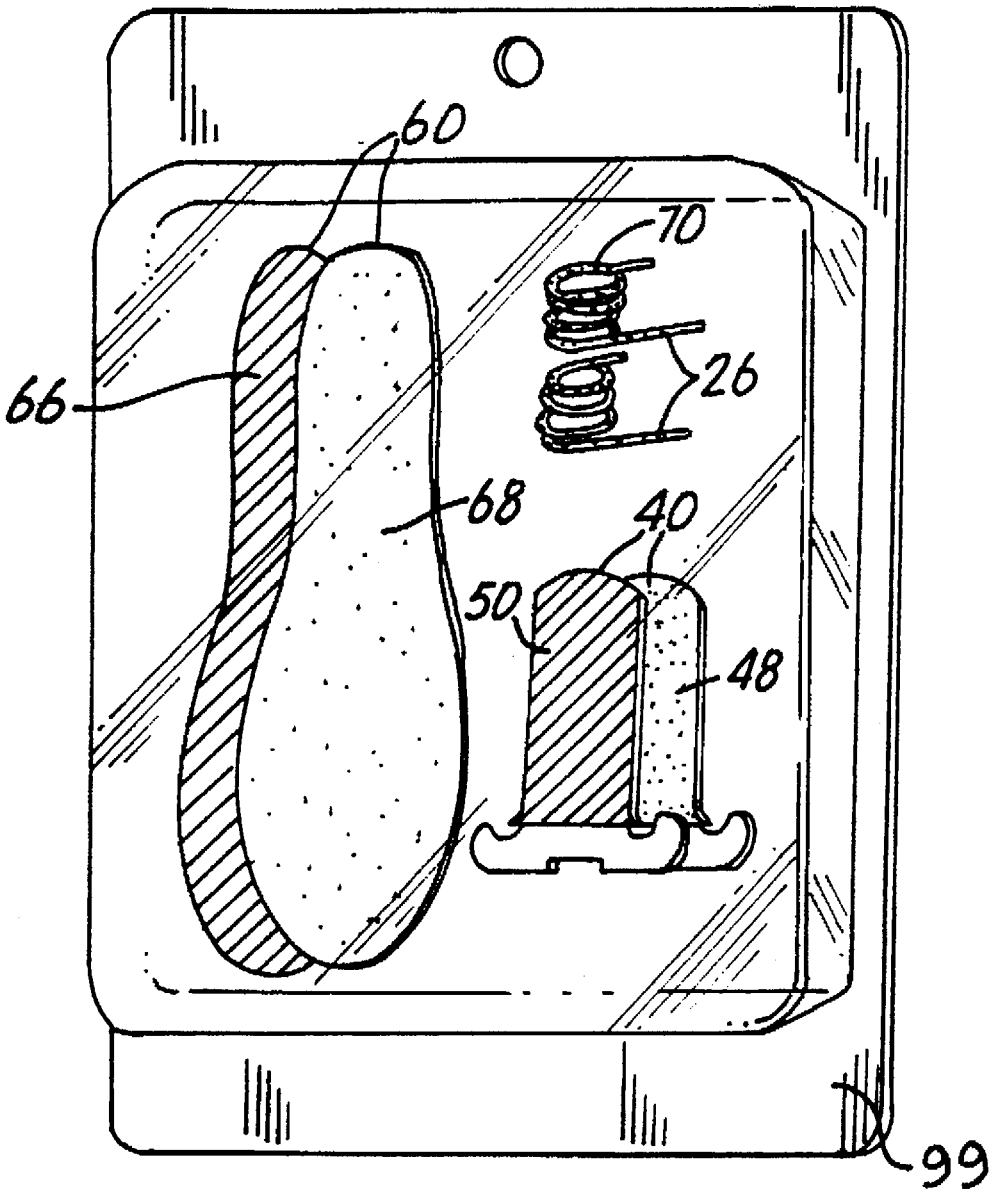
FIG. 7 is a perspective view of a kit for decorating an item of footwear in accordance with the present invention.

Yet another method for reversibly mounting tongue 40 to upper 12 is shown in FIG. 6. In accordance with this method, upper 12 is not provided with a U-shaped member 84, and tongue 40 does not include either a rigid or semi-rigid insert 100 or a hook connector 70. Rather, the portion of upper 12 at the lower end of opening 18 is provided with a pair of spaced apertures or eyelets 110, and the attachment end of tongue 40 is provided with a pair of similarly spaced apertures or eyelets 112. Before threading shoelace 26 through eyelets 24, the shoelace is first threaded through eyelets 110 and the corresponding eyelets 112 in tongue 40 which not only positions the tongue with respect to upper 12, but which also connects these members to one another in a removable fashion. The shoelace 26 may then be threaded through eyelets 24 in a conventional fashion and tightened to draw the opposed edges 20 and 22 of flaps 16 toward one another over the foot of the wearer. By removing the shoelace 26 from lacing eyelets 24 and eyelets 110 and 112, tongue 40 can be inverted and then remounted to sneaker 10 to display the indicia on the opposite side thereof.

The overall appearance of sneaker 10 can be changed not only by reversing tongue 40 and insole 60 to display the indicia on the opposite sides thereof, but also by removing either the tongue, insole or both and replacing same with another having entirely different indicia. Further, the shoelace 26 can also be removed and replaced with a shoelace having different indicia which coordinate with the indicia on the new tongue and insole. Thus, for example, on one occasion a wearer may desire sneaker 10 to have a somewhat formal look wherein sneaker 10 is fitted with a tongue 40 and an insole 60 in which indicia 48 and 68 are a solid black color or black design and indicia 50 and 66 are a solid white color or white design, and a shoelace 26 in which indicia 70 is a solid black color or pattern, a solid white color or pattern or a pattern comprising both black and white. On another occasion, the wearer may desire sneaker 10 to have a more casual look. To achieve this more casual look, the wearer simply has to remove the tongue 40, insole 60 and shoelace 26 and replace them with similar components having different indicia; i.e., for example, a tongue 40 and insole 60 in which indicia 48 and 68 are a predominantly red plaid and indicia 50 and 66 are a predominantly blue paisley, and a shoelace 26 in which indicia 70 is a predominantly red plaid, a predominantly blue paisley, or some other coordinating indicia including red and/or blue. These components can thus be made available with different indicia in convenient packages 99 consisting of two tongues 40, two insoles 60 (one right insole and one left insole), and two shoelaces 26 so that a wearer may select a package 99 of components having indicia which coordinate with a particular outfit.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. A pair of footwear comprising a right item of footwear shaped to fit a right foot and a left item of footwear shaped to fit a left foot, each of said right and left items of footwear having a transparent upper and a sole connected to said upper, a tongue for each of said items of footwear, said tongue having opposed front and back surfaces and mounting means for removably mounting said tongue to said upper in a first position with said front surface facing away from said sole and said back surface facing toward said sole and in a second position with said front surface facing toward said sole and said back surface facing away from said sole, non-transparent indicia formed on said front and back surfaces of said tongue, an insole for each of said items of footwear, said insole having opposed top and bottom surfaces and being removably insertable within one of said uppers in a first use position with said top surface facing away from said sole and said bottom surface facing toward said sole and within another one of said uppers in a second use position with said top surface facing toward said sole and said bottom surface facing away from said sole, and non-transparent indicia formed on said top and bottom surfaces of said insole, wherein said mounting means includes a hook member connected to an attachment end of said tongue and a receiving aperture formed in said upper, said receiving aperture being sized and shaped for removably receiving said hook member in assembled position.

2. A pair of footwear, comprising a right item of footwear shaped to fit a right foot and a left item of footwear shaped to fit a left foot, each of said right and left items of footwear having a transparent upper and a sole connected to said upper, a tongue for each of said items of footwear, said tongue having opposed front and back surfaces and mounting means for removably mounting said tongue to said upper in a first position with said front surface facing away from said sole and said back surface facing toward said sole and in a second position with said front surface facing toward said sole and said back surface facing away from said sole, non-transparent indicia formed on said front and back surfaces of said tongue, an insole for each of said items of footwear, said insole having opposed top and bottom surfaces and being removably insertable within one of said uppers in a first use position with said top surface facing away from said sole and said bottom surface facing toward said sole and within another one of said uppers in a second use position with said top surface facing toward said sole and said bottom surface facing away from said sole, non-transparent indicia formed on said top and bottom surfaces of said insole, and a plurality of opposed lacing eyelets formed on said upper, a receiving cavity formed in said upper at one end of said plurality of opposed lacing eyelets and a lace threaded through said plurality of opposed lacing eyelets, wherein said mounting means includes a mounting member fixedly connected to an attachment end of said tongue and receivable within said receiving cavity in assembled position, said mounting member including a pair of opposed extensions projecting outwardly from said receiving cavity in said assembled position of said mounting member.

3. A packaged kit for decorating items of footwear having an upper and a sole connected to the upper, said kit comprising a tongue for each item of footwear, said tongue having opposed front and back surfaces and mounting means for removably mounting said tongue to the upper in a first position with said front surface facing away from the sole and said back surface facing toward the sole and in a second position with said front surface facing toward the sole and said back surface facing away from the sole, an insole for each item of footwear, said insole being removably insertable in a use position within the uppers and having a top surface facing away from the sole and a bottom surface facing toward the sole in said use position in one of the items of footwear, said top surface facing toward the sole and said bottom surface facing away from the sole in said use position in another one of the items of footwear, and a package, said tongues and said insoles being contained in said package separately from said items of footwear.

4. The kit as claimed in claim 3, further comprising first non-transparent indicia formed on said front surfaces of said tongues and second non-transparent indicia different from said first non-transparent indicia formed on said back surfaces of said tongues.

5. The kit as claimed in claim 4, wherein said first and second non-transparent indicia comprise different colors.

6. The kit as claimed in claim 4, further comprising third non-transparent indicia formed on said top surfaces of said insoles and fourth non-transparent indicia different from said third non-transparent indicia formed on said bottom surfaces of said insoles.

7. The kit as claimed in claim 6, wherein said first indicia is the same as said fourth indicia and said second indicia is the same as said third indicia.

8. The kit as claimed in claim 6, wherein each upper of the items of footwear includes a plurality of opposed lacing eyelets, said kit further comprising a lace for each item of footwear including fifth indicia for threaded engagement through the plurality of opposed lacing eyelets.

9. The kit as claimed in claim 8, wherein said fifth indicia is selected from the group consisting of said first and second indicia.

10. The kit as claimed in claim 3, wherein each upper of the items of footwear includes a plurality of opposed lacing eyelets, said kit further comprising a lace for each item of footwear for threaded engagement through the plurality of opposed lacing eyelets.

* * * * *